United States Patent [19]

Melton et al.

[11] 4,398,969

[45] Aug. 16, 1983

[54] SHAPE-MEMORY ALLOY BASED ON COPPER, ZINC AND ALUMINUM AND PROCESS FOR PREPARING IT

[75] Inventors: Keith Melton, Busslingen; Olivier Mercier, Ennetbaden; Helmut Riegger, Busslingen, all of Switzerland

[73] Assignee: BBC Brown, Boveri & Company, Limited, Baden, Switzerland

[21] Appl. No.: 320,966

[22] PCT Filed: Mar. 2, 1981

[86] PCT No.: PCT/CH81/00024

§ 371 Date: Nov. 3, 1981

§ 102(e) Date: Nov. 3, 1981

[87] PCT Pub. No.: WO81/02587

PCT Pub. Date: Sep. 17, 1981

[30] Foreign Application Priority Data

Mar. 3, 1980 [CH] Switzerland ..... 80200186

[51] Int. Cl.[3] ..... C22C 9/01; C22C 9/04

[52] U.S. Cl. ..... 148/11.5 C; 148/11.5 P; 148/402; 148/413; 148/434; 148/436

[58] Field of Search ..... 148/11.5 P, 11.5 C, 148/11.5 R, 402, 413, 434, 436

[56] References Cited

U.S. PATENT DOCUMENTS 4,144,104 3/1979 Brooks ..... 148/402

4,285,739 8/1981 Deruyttere et al. ..... 148/11.5 P

*Primary Examiner*—W. Stallard

*Attorney, Agent, or Firm*—Oblon, Fisher, Spivak, McClelland & Maier

[57] ABSTRACT

A fine-grained shape-memory alloy of the Cu/Zn/Al type, prepared by powder metallurgy, exhibiting the beta-high temperature phase, having dispersed in the matrix dispersoids in the form of $Y_2O_3$ and or $TiO_2$ particles which limit grain growth, and a process for preparing this alloy using mechanical alloying.

12 Claims, No Drawings

SHAPE-MEMORY ALLOY BASED ON COPPER, ZINC AND ALUMINUM AND PROCESS FOR PREPARING IT

BACKGROUND OF THE INVENTION

1. Field of the Invention

This invention relates to a shape-memory alloy Cu/Zn/Al and to a process for preparing it.

2. Description of the Prior Art

Memory alloys based on the Cu/Zn/Al system are known and have been described in various publications (e.g., U.S. Pat. No. 3,783,037). Such memory alloys, which belong generally to the type having a beta-high temperature phase, are usually produced by fusion techniques.

When these alloys are cast they usually exhibit a coarse texture, which becomes still coarser because of grain growth during subsequent annealing in the temperature range of the beta-phase solid solution, and which cannot be eliminated by hot working. As a result, the mechanical characteristics, particularly elongation and notch ductility, of shape-memory alloys produced in this manner are relatively poor, and their field of application is limited.

Accordingly, a need has existed to improve the metallurgy and preparative technology of these shape-memory alloys so that additional practical applications may be open to them.

It has already been proposed to produce shape-memory alloys of the Cu/Zn/Al type by powder metallurgy, starting with previously prepared alloys corresponding to the final composition (e.g., M. Follon, E. Aernoudt, Powder-metallurgically processed shape-memory alloys, 5th European Symposium on Powder Metallurgy, Stockholm 1978, pp. 275–281). In such processes the prepared powder is encapsulated, cold compacted, hot pressed and extruded.

However, these methods are not adapted to all practical requirements and the finished articles often leave something to be desired in their mechanical properties.

SUMMARY OF THE INVENTION

The basic object of the invention is to provide shape-memory alloys based on copper, zinc, and aluminum and a process for their preparation which provides dense, compact articles having good mechanical properties and at the same time accurately reproducible values of the transition temperature and other properties associated with the shape-memory effect.

This object is attained according to the invention by providing a shape-memory alloy based on copper, zinc and aluminum, which is present in the beta-phase, characterized in that it is prepared by powder metallurgical techniques from pre-alloys and pre-mixtures, that it has a fine-grained structure with a grain size of at most 100 micrometers and that at least one metal oxide is present as a dispersoid in the matrix formed by the beta-phase.

This object is further attained by providing a process for preparing a shape-memory alloy based on copper, zinc and aluminum, characterized by the following steps:

(a) preparing a Powder A having a particle size of 10 to 200 micrometers from a copper-rich pre-alloy containing 60 to 80% by weight Cu, 0 to 1% by weight Al, balance Zn; preparing a Powder B having a particle size from 5 to 100 micrometers by mixing and/or alloying of 95 to 99.5% by weight aluminum powder with 0.5 to 5% weight of copper powder; preparing a Powder C of pure copper having a particle size of 10 to 100 micrometers; preparing a Powder d of $Y_2O_3$ or $TiO_2$ or any mixture of these oxides having a particle size of 10 to 100 micrometers;

(b) mixing 0.5 to 15% by weight of Powder B, 0 to 80% by weight of Powder C and 0.5 to 2% by weight of Powder D, and the balance Powder A, under toluene, ethyl alcohol or another organic solvent in a ball mill or an attrition mill for at least 5 hours at room temperature and finally evaporating the solvent;

(c) isostatically pressing the dried powder mixture in a plastic or rubber tube at a pressure of at least 3000 bar;

(d) reducing and pre-sintering the compact prepared in step (c) in a hydrogen or hydrogen/nitrogen atmosphere at a temperature between 700° and 1000° C. for at least 30 minutes;

(e) sintering the reduced and pre-sintered compact in an argon atmosphere at least 700° C. for at least 10 hours;

(f) alternately hot working at a temperature between 700° and 1000° C. and homogenizing in an inert gas atmosphere at a temperature of at least 700° C. for at least 30 minutes;

(g) finally annealing in an argon atmosphere at a temperature between 700° and 1050° C. for 10 to 15 minutes and immediately thereafter quenching in water.

The nucleus of the invention lies in starting with neither elemental powders nor with powders corresponding to one of the ultimate alloys, but rather with a mixture of pre-alloyed powders and specially formulated powder mixtures, and mechanically alloying these powders with suitable metal oxide powders. By this procedure the ductility can be adjusted as required for working while maintaining great freedom with respect to the composition. The grain size of the crystallites in the finished article can for the most part be predetermined. Grain growth is prevented by incorporating the proper dispersoids. At the same time, oxide shells which hinder the homogenization and adversely effect the mechanical properties need not be feared.

DESCRIPTION OF THE PREFERRED EMBODIMENTS

The invention will be described by means of the following working examples:

EXAMPLE 1

A rod of a shape-memory alloy was prepared having the following final composition of the matrix:

| | |
|---|---|
| Zinc | 20.25% by weight |
| Aluminum | 6.25% by weight |
| Copper | 73.5% by weight |

The alloy also contained 2% by weight of yttrium oxide as a dispersoid.

The following powders were used as starting materials:

Powder A: Brass: 60% by weight copper; 40% by weight zinc; melted, atomized; grain size 10–200 micrometers; manufacturer, Baudier.

Powder B: Pure aluminum + pure copper: 99.5% by weight aluminum; 0.5% by weight copper; grain size 23–28 micrometers; manufacturer, Alcoa.

Powder C: Pure copper: 100% by weight copper; grain size 0–44 micrometers; manufacturer, Baudier.

Powder D: Yttrium oxide: 100% by weight yttrium oxide; grain size <1 micron.

The following amounts were mixed, milled, and mechanically alloyed for 10 hours under toluene in an attrition mill.

| | | |
|---|---|---|
| Powder A: | 495 | g |
| Powder B: | 61.6 | g |
| Powder C: | 423.4 | g |
| Powder D: | 20 | g |
| Total | 1000 | g |

The powder mixture was dried by evaporation of the toluene, and subsequently 250 g of the mixture were poured into a rubber tube having an inner diameter of 20 mm and isostatically pressed under a pressure of 3000 bar to a cylinder of 18 mm diameter and 240 mm height. The green compact was reduced and presintered in a hydrogen steam at a temperature of 930° C. for 1½ hours, and then the sintering was completed in an argon stream at a temperature of 960° C. for 18 hours. The rough sintered billet was turned to a diameter of 17 mm, placed in a tube of annealed copper having an external diameter of 20 mm, and completely encapsulated by closing the end with a cover and soldering in an argon atmosphere. The workpiece so prepared was then alternately subjected to hot working and a homogenizing annealing of one hour each time in an argon stream at a temperature of 940° C. In this case the hot working consisted of circular swaging at 940° C., whereby in the first swaging pass the diameter of the rod was reduced to 18 mm and in each successive pass the diameter was reduced by 2 mm. In this process two hot working operations were performed for each homogenization annealing. After the rod had been swaged down to a diameter of 8 mm, it was subjected to a final annealing at a temperature of 920° C. and immediately quenched in water. The density of the matrix, determined by testing, was 99.3–99.7% of the theoretical value.

Of course, the hot working/homogenizing cycle can be continued as long as desired, until the final shape of the workpiece is attained. When the theoretical density has been reached, further annealing is not generally required.

EXAMPLE 2

A strip of a shape-memory alloy was prepared having the following final composition of the matrix:

| | |
|---|---|
| Zinc | 10.10% by weight |
| Aluminum | 10.05% by weight |
| Copper | 79.85% by weight |

The alloy also contained 1% by weight of yttrium oxide as a dispersoid.

The powders of Example 1, in the following proportions, were mixed, milled and mechanically alloyed for 8 hours under ethyl alcohol in a ball mill:

| | |
|---|---|
| Powder A: | 250 g |
| Powder B: | 100 g |
| Powder C: | 640 g |
| Powder D: | 10 g |
| Total | 1000 g |

After evaporation of the ethyl alcohol, 240 g of the powder mixture were placed in an annealed tombac tube having an inner diameter of 20 mm and a wall thickness of 1.6 mm, and completely encapsulated by covering the ends and soldering in an argon atmosphere. Thereupon the tube and powder were isostatically pressed at a pressure of 10,000 bar, the green compact was reduced and pre-sintered in a hydrogen stream for 2 hours at a temperature of 880° C., and the sintering was completed in an argon stream at a temperature of 840° C. for 22 hours. The workpiece was then reduced by two circular swaging passes at 920° C. to 18 and then to 16 mm diameter and homogenized for one hour at 940° C. in an argon stream. This was followed by two more circular swaging passes at 920° C., so that the bar finally had a diameter of 13 mm. After an additional homogenization for one hour at 940° C., the bar was rolled down in several successive hot rolling passes, each reducing the cross section by 20–25%, to a strip 1.6 mm thick and 18 mm wide. After a final annealing at 960° C. for 12 minutes the strip was quenched in water. The density of the matrix in the finished strip was 99.6%.

EXAMPLE 3

A rectangular bar was prepared from a shape-memory alloy having the following composition of the matrix:

| | |
|---|---|
| Zinc | 5% by weight |
| Aluminum | 12% by weight |
| Copper | 83% by weight |

The alloy also contained 0.5% by weight of titanium dioxide as a dispersoid.

Powders A, B, C and D*(100% titanium dioxide) were weighed out in the following amounts and mixed, milled and mechanically alloyed for 10 hours under toluene:

| | |
|---|---|
| Powder A: | 125 g |
| Powder B: | 120 g |
| Powder C: | 750 g |
| Powder D*: | 5 g (100% $TiO_2$) |
| Total: | 1000 g |

After drying, 600 g of this powder mixture were placed in a rubber tube having an inner diameter of 50 mm and isostatically pressed at a pressure of 10,000 bar to a cylinder 46 mm in diameter and 90 mm high. The green compact was reduced and pre-sintered in a hydrogen/nitrogen stream at a temperature of 900° C. for 2 hours and then the sintering was completed at a temperature of 980° C. for 20 hours in an argon atmosphere. The rough sintered billet was turned to a diameter of 45 mm, placed in the receiving cylinder of an extrusion press and extruded at a temperature of 900° C. into a rectangular bar of square cross section 10 mm on an edge. Accordingly, the reduction ratio (decrease in cross section) amounted to 16:1. Thereupon the bar was homogenized at a temperature of 980° C. for 30 minutes and then drawn down in three passes on a hot drawing bench at 800° C. to 7 mm on an edge. After a final annealing at 920° C. for 15 minutes in an argon stream, the bar was quenched in water. The density of the matrix of the finished bar was 99.7% of the theoretical value.

The invention is not limited to the magnitudes and values disclosed in the examples. The powder compositions and particle sizes can be varied completely generally within the following limits:

| | |
|---|---|
| Powder A: | Pre-alloy<br>Copper: 60–80% by weight<br>Aluminum: 0–1% by weight<br>Zinc: Balance<br>Particle size: 10–200 micrometers |
| Powder B: | Pre-mix and/or pre-alloy(alloyed mechanically or by fusion techniques)<br>Aluminum: 95–99.5% by weight<br>Copper: 0.5–5% by weight<br>Particle size: 5–100 micrometers |
| Powder C: | Pure metal<br>Copper: 100% by weight<br>Particle size: 10–100 micrometers |
| Powder D: | Metal oxide (dispersoid<br>Yttrium oxide: 0–100% by weight<br>Titanium dioxide: 0–100% by weight |

Of course, Powder A could also have a different composition, for example, elemental zinc could be added. However, considering the loss of this element by burning and evaporation, this is not recommended in most instances.

The proportions of the powder mixtures can be within the following limits:

| | |
|---|---|
| Powder B: | 0.5–15% by weight |
| Powder C: | 0–80% by weight |
| Powder D: | 0.5–2% by weight |
| Powder A: | Balance |

A pressure of at least 3000 bar is required for the isostatic pressing.

Reduction and pre-sintering of the compact can conveniently be carried out in the temperature range of 700° to 1000° C. for at least 30 minutes in a hydrogen or hydrogen/nitrogen stream. The sintering of the billet must be carried out above the temperature of the eutectoid transition, i.e., at at least 700° C. for 10 hours in an argon atmosphere, in order to obtain as homogeneous a structure as possible. The hot working, which can be hot pressing, hot extrusion, hot forging, hot rolling, hot drawing and/or hot circular swaging, can be accomplished at temperatures between 700° and 1000° C.; likwise the interposed homogenization in an inert gas atmosphere (intermediate annealing) can be carried out at at least 700° C. for at least 30 minutes. The final annealing in an argon atmosphere is carried out at a temperature between 700° and 1050° C. (beta-phase solid solution region) for 10 to 15 minutes and the workpiece is immediately thereafter quenched in water.

For most types of hot working it is desirable to encapsulate the material beforehand in a ductile metallic shell which does not chemically react with the alloy, and which in most practical applications is removed after the shaping as a surface layer by chemical or mechanical means. Suitable materials for the shell are principally annealed metals and alloys such as copper, copper alloys, and soft iron. The encapsulation can be performed immediately before the hot working, in which case the sintered billet undergoes a mechanical surface treatment by turning, milling, smoothing, or the like, or the powder can instead be immediately placed into a rubber or plastic tube in a suitable tube, capsule, etc.

By the powder metallurgical process of the invention and the dispersion alloys prepared thereby it is possible to prepare articles from shape-memory alloys of the Cu/Zn/Al type which, in comparison with the currently available articles, i.e., those prepared by fusion metallurgical techniques, exhibit a fine-grained-structure and good reproducibility of their physical properties. Their structures may have an average grain size of 30 micrometers, which remains unchanged even by an indefinitely long annealing at a temperature up to 950° C. and their mechanical properties, especially the elongation, notch toughness and the workability of the billets, are significantly better than those of cast and/or additionally hot worked articles. These shape-memory alloys exhibit both a one-way and a two-way shape-memory effect and are characterized by a martensite transition point $M_s$ in the temperature range of from −200° to +300° C.

What is claimed is:

1. A shape-memory alloy based on copper, zinc and aluminum, which is present in the beta-phase, characterized in that it is prepared by powder metallurgical techniques from pre-alloys and pre-mixtures, that it has a fine-grained structure with a grain size of at most 100 micrometers and that at least one metal oxide is present in an amount of 0.5 to 2% by weight of the entire mass of the alloy as a dispersoid in the matrix formed by the beta phase.

2. A shape-memory alloy according to claim 1, characterized in that, the dispersoid contains a yttrium oxide or a titanium oxide.

3. A shape-memory alloy according to claim 1, characterized in that, the average diameter of the dispersoid particles is 10 Angstroms to 1 micrometer.

4. A shape-memory alloy according to claim 1, characterized in that, the matrix formed by the beta-phase comprises 0.5 to 45% by weight of zinc, 0.5 to 15% by weight of aluminum, balance copper.

5. A shape-memory alloy according to claim 1, characterized in that, its structure has an average grain size of 30 micrometers, which remains unchanged even by an indefinitely long annealing at a temperature up to 950° C.

6. A shape-memory alloy according to claim 1, characterized in that, it exhibits both a one-way and a two-way shape-memory effect, and that the martensite transition point $M_S$ is in the temperature range from −200° to +300° C.

7. A process for preparing a shape-memory alloy based on copper, zinc and aluminum, characterized by the following steps:

(a) preparing a Powder A having a particle size of 10 to 200 micrometers from a copper-rich pre-alloy containing 60 to 80% by weight Cu, 0 to 1% by weight Al, balance Zn; preparing a Powder B having a particle size from 5 to 100 micrometers by mixing and/or alloying of 95 to 99.5% by weight aluminum powder with 0.5 to 5% by weight of copper powder; preparing a Powder C of pure copper having a particle size of 10 to 100 micrometers; preparing a Powder D of $Y_2O_3$ or $TiO_2$ or any mixture of these oxides having a particle size of 10 to 100 micrometers;

(b) mixing 0.5 to 15% by weight of Powder B, 0 to 80% by weight of Powder C and 0.5 to 2% by weight of Powder D, and the balance Powder A, under toluene, ethyl alcohol or another organic solvent in a ball mill or an attrition mill for at least 5 hours at room temperature and finally evaporating the solvent;

(c) isostatically pressing the dried powder mixture in a plastic or rubber tube at a pressure of at least 3000 bar;

(d) reducing and pre-sintering the compact prepared in step (c) in a hydrogen or hydrogen/nitrogen atmosphere at a temperature between 700° and 1000° C. for at least 30 minutes;

(e) sintering the reduced and pre-sintered compact in an argon atmosphere at at least 700° C. for at least 10 hours;

(f) alternately hot working at a temperature between 700° and 1000° C. and homogenizing in an inert gas atmosphere at a temperature of at least 700° C. for at least 30 minutes;

(g) finally annealing in an argon atmosphere at a temperature between 700° and 1050° C. for 10 to 15 minutes and immediately thereafter quenching in water.

8. A process according to claim 7, characterized in that, the sintered billet, prior to step (f) undergoes a mechanical surface treatment and thereupon is encapsulated in a shell of annealed copper, iron or a soft copper alloy.

9. A process according to claim 8, characterized in that the mechanical surface treatment is a turning and the billet so treated is introduced into an annealed copper tube and the tube is then completely sealed by covering the end of the tube with a plug and soldering under an argon atmosphere.

10. A shape-memory alloy based on copper, aluminum and zinc, these metals present in the beta-phase, having a metal oxide present in an amount of 0.5 to 2% by weight of the entire mass of the alloy as a dispersoid in the matrix formed by the beta-phase and characterized by having a fine grain size.

11. A shape-memory alloy based on copper, aluminum and zinc, these metals present in the beat-phase, consisting essentially of 95–50% Cu, 0.5–15% Al, 6–20% zinc, these percentages being percent by weight, and 0.5 to 2% of a metal oxide present as a dispersoid in the matrix formed by the beta-phase, characterized by having a fine grain size.

12. The shape-memory alloy of claim 10 wherein the copper is present in from 73.5–83% by weight, the aluminum is present in from 6.25–12% by weight and the zinc is present in from 5 to 20.25% by weight, the metal oxide is selected from the group consisting of titanium dioxide and yttrium oxide and the grain size of the alloy is $\leqq 100$ microns.

* * * * *